US008632423B2

(12) United States Patent
Stefan et al.

(10) Patent No.: US 8,632,423 B2
(45) **Date of Patent: *Jan. 21, 2014**

(54) GOLF BALL

(75) Inventors: Ryan L. Stefan, Carlsbad, CA (US); Dean A. Snell, San Marcos, CA (US); Hyun J. Kim, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/552,367

(22) Filed: Jul. 18, 2012

(65) Prior Publication Data

US 2012/0283042 A1 Nov. 8, 2012

Related U.S. Application Data

(63) Continuation of application No. 13/243,777, filed on Sep. 23, 2011, now Pat. No. 8,241,150, which is a continuation of application No. 12/378,386, filed on Feb. 13, 2009, now Pat. No. 8,047,933.

(60) Provisional application No. 61/066,438, filed on Feb. 19, 2008, provisional application No. 61/131,562, filed on Jun. 9, 2008.

(51) Int. Cl.
*A63B 37/12* (2006.01)

(52) U.S. Cl.
USPC ..... 473/378

(58) Field of Classification Search
USPC ..... 473/378–384
See application file for complete search history.

(56) References Cited

U.S. PATENT DOCUMENTS

| | | | |
|---|---|---|---|
| 4,115,475 | A | 9/1978 | Foy et al. |
| 4,123,061 | A | 10/1978 | Dusbiber |
| 4,153,772 | A | 5/1979 | Schwesig et al. |
| 4,183,876 | A | 1/1980 | Coran et al. |
| 4,195,015 | A | 3/1980 | Deleens et al. |
| 4,230,838 | A | 10/1980 | Foy et al. |
| 4,331,786 | A | 5/1982 | Foy et al. |
| 4,332,920 | A | 6/1982 | Foy et al. |
| 4,431,193 | A | 2/1984 | Nesbitt |
| 4,546,980 | A | 10/1985 | Gendreau et al. |
| 4,726,590 | A | 2/1988 | Molitor |
| 4,728,693 | A | 3/1988 | Dröscher et al. |
| 4,755,552 | A | 7/1988 | Jadamus et al. |
| 4,792,141 | A | 12/1988 | Llort |

(Continued)

FOREIGN PATENT DOCUMENTS

| | | |
|---|---|---|
| JP | 62267357 | 11/1987 |
| JP | 63221157 | 9/1988 |

(Continued)

*Primary Examiner* — Raeann Gorden
(74) *Attorney, Agent, or Firm* — Klarquist Sparkman, LLP

(57) ABSTRACT

The present invention is to a golf ball having an equator at latitude 0° and two poles; and an equator region defined by latitudes 0 to 25°, a shoulder region defined by latitudes from more than 25° to less than 65°, and a pole region defined by latitudes 65° to 90°; and a dimple pattern on the surface of the golf ball having an average dimple volume of the equator region Ve, an average dimple volume of the shoulder region, Vs, and an average dimple volume of the pole region, Vp such that the ratio Vs/Ve is less than 0.97 and the ratio Vp/Vs is less than 0.97.

5 Claims, 3 Drawing Sheets

(56) References Cited

U.S. PATENT DOCUMENTS

| | | | | |
|---|---|---|---|---|
| 4,838,556 | A | 6/1989 | Sullivan | |
| 4,840,993 | A | 6/1989 | Bartz | |
| 4,844,471 | A | 7/1989 | Terence et al. | |
| 4,852,884 | A | 8/1989 | Sullivan | |
| 4,894,411 | A | 1/1990 | Okada et al. | |
| 4,955,966 | A | 9/1990 | Yuki | |
| 5,090,705 | A * | 2/1992 | Oka et al. | 473/384 |
| 5,334,673 | A | 8/1994 | Wu | |
| 5,385,776 | A | 1/1995 | Maxfield et al. | |
| 5,436,295 | A | 7/1995 | Nishikawa et al. | |
| 5,460,367 | A | 10/1995 | Horiuchi | |
| 5,484,870 | A | 1/1996 | Wu | |
| 5,691,066 | A | 11/1997 | Rajagopalan | |
| 5,692,974 | A | 12/1997 | Wu et al. | |
| 5,948,862 | A | 9/1999 | Sano et al. | |
| 5,959,059 | A | 9/1999 | Vedula et al. | |
| 5,962,553 | A | 10/1999 | Ellsworth | |
| 6,012,991 | A | 1/2000 | Kim et al. | |
| 6,042,489 | A | 3/2000 | Renard et al. | |
| 6,066,055 | A * | 5/2000 | Nishino | 473/384 |
| 6,100,321 | A | 8/2000 | Chen | |
| 6,117,024 | A | 9/2000 | Dewanjee | |
| 6,180,722 | B1 | 1/2001 | Dalton et al. | |
| 6,183,382 | B1 | 2/2001 | Kim et al. | |
| 6,329,458 | B1 | 12/2001 | Takesue et al. | |
| 6,426,387 | B1 | 7/2002 | Kim | |
| 6,435,986 | B1 | 8/2002 | Wu et al. | |
| 6,476,176 | B1 | 11/2002 | Wu | |
| 6,485,378 | B1 | 11/2002 | Boehm | |
| 6,508,724 | B2 | 1/2003 | Dalton | |
| 6,508,725 | B1 | 1/2003 | Kim | |
| 6,562,906 | B2 | 5/2003 | Chen | |
| 6,569,037 | B2 | 5/2003 | Ichikawa et al. | |
| 6,582,326 | B2 | 6/2003 | Wu et al. | |
| 6,610,812 | B1 | 8/2003 | Wu et al. | |
| 6,616,552 | B2 | 9/2003 | Takesue et al. | |
| 6,635,716 | B2 | 10/2003 | Voorheis et al. | |
| 6,653,403 | B2 | 11/2003 | Dalton et al. | |
| 6,692,379 | B2 | 2/2004 | Morgan et al. | |
| 6,762,244 | B2 | 7/2004 | Rajagopalan et al. | |
| 6,762,273 | B2 | 7/2004 | Dewanjee | |
| 6,770,360 | B2 | 8/2004 | Mientus et al. | |
| 6,776,942 | B2 | 8/2004 | Kim | |
| 6,794,447 | B1 | 9/2004 | Kim et al. | |
| 6,812,276 | B2 | 11/2004 | Yeager | |
| 6,835,146 | B2 | 12/2004 | Jordan et al. | |
| 6,861,474 | B2 | 3/2005 | Kim | |
| 6,878,075 | B2 | 4/2005 | Kim | |
| 6,903,178 | B2 | 6/2005 | Wu et al. | |
| 6,905,423 | B2 | 6/2005 | Morgan et al. | |
| 6,924,337 | B2 | 8/2005 | Kim et al. | |
| 6,930,150 | B2 | 8/2005 | Kim et al. | |
| 6,939,924 | B2 | 9/2005 | Kim et al. | |
| 6,951,519 | B2 | 10/2005 | Dewanjee et al. | |
| 6,960,629 | B2 | 11/2005 | Voorheis et al. | |
| 7,001,286 | B2 | 2/2006 | Kim et al. | |
| 7,026,399 | B2 | 4/2006 | Kim et al. | |
| 7,037,985 | B2 | 5/2006 | Kim et al. | |
| 7,041,769 | B2 | 5/2006 | Wu et al. | |
| 7,163,471 | B2 | 1/2007 | Kim et al. | |
| 7,169,861 | B2 | 1/2007 | Kim et al. | |
| 7,320,651 | B2 * | 1/2008 | Sajima | 473/383 |
| 7,332,533 | B2 | 2/2008 | Kim et al. | |
| 7,384,352 | B2 * | 6/2008 | Ohama et al. | 473/383 |
| 7,491,136 | B2 | 2/2009 | Deng et al. | |
| 8,021,590 | B2 | 9/2011 | Kuttappa | |
| 8,047,933 | B2 * | 11/2011 | Stefan et al. | 473/384 |
| 8,241,150 | B2 * | 8/2012 | Stefan et al. | 473/384 |
| 2001/0019971 | A1 | 9/2001 | Hayashi et al. | |
| 2002/0040111 | A1 | 4/2002 | Rajagopalan | |
| 2002/0045499 | A1 | 4/2002 | Takemura et al. | |
| 2003/0012902 | A1 | 1/2003 | Kim et al. | |
| 2003/0096661 | A1 | 5/2003 | Kim | |
| 2003/0119989 | A1 | 6/2003 | Ladd et al. | |
| 2003/0158312 | A1 | 8/2003 | Chen | |
| 2003/0224871 | A1 | 12/2003 | Kim et al. | |
| 2004/0019138 | A1 | 1/2004 | Voorheis et al. | |
| 2004/0059062 | A1 | 3/2004 | Kim | |
| 2004/0082408 | A1 | 4/2004 | Sullivan et al. | |
| 2004/0092336 | A1 | 5/2004 | Kim et al. | |
| 2004/0097653 | A1 | 5/2004 | Kim et al. | |
| 2004/0180733 | A1 | 9/2004 | Kim | |
| 2004/0209708 | A1 | 10/2004 | Bulpett et al. | |
| 2004/0235584 | A1 | 11/2004 | Chao et al. | |
| 2004/0236030 | A1 | 11/2004 | Kim et al. | |
| 2004/0248669 | A1 | 12/2004 | Kim et al. | |
| 2004/0248670 | A1 | 12/2004 | Okamoto et al. | |
| 2004/0248671 | A1 | 12/2004 | Kim et al. | |
| 2004/0248672 | A1 | 12/2004 | Jeon et al. | |
| 2004/0254298 | A1 | 12/2004 | Kim et al. | |
| 2005/0059756 | A1 | 3/2005 | Kim et al. | |
| 2005/0239575 | A1 | 10/2005 | Chao et al. | |
| 2005/0250601 | A1 | 11/2005 | Kim et al. | |
| 2005/0261424 | A1 | 11/2005 | Snell et al. | |
| 2006/0014898 | A1 | 1/2006 | Kim | |
| 2006/0030427 | A1 | 2/2006 | Kim et al. | |
| 2006/0166761 | A1 | 7/2006 | Kim et al. | |
| 2006/0166762 | A1 | 7/2006 | Kim et al. | |
| 2006/0172823 | A1 | 8/2006 | Loper et al. | |
| 2006/0247074 | A1 | 11/2006 | Kim et al. | |
| 2007/0015605 | A1 | 1/2007 | Kim et al. | |
| 2007/0054754 | A1 | 3/2007 | Kim et al. | |
| 2007/0100085 | A1 | 5/2007 | Kim et al. | |
| 2007/0142568 | A1 | 6/2007 | Kim et al. | |
| 2007/0232756 | A1 | 10/2007 | Kim et al. | |
| 2007/0238552 | A1 | 10/2007 | Kim et al. | |
| 2007/0243954 | A1 | 10/2007 | Sullivan et al. | |
| 2008/0090678 | A1 | 4/2008 | Kim et al. | |
| 2008/0139334 | A1 | 6/2008 | Willett et al. | |
| 2008/0146374 | A1 | 6/2008 | Beach et al. | |
| 2008/0176677 | A1 | 7/2008 | Snell et al. | |
| 2008/0214326 | A1 | 9/2008 | Kim et al. | |
| 2008/0274825 | A1 | 11/2008 | Kim et al. | |
| 2009/0023518 | A1 | 1/2009 | Kim et al. | |
| 2009/0163298 | A1 | 6/2009 | Kim | |
| 2009/0170634 | A1 | 7/2009 | Loper et al. | |
| 2009/0176601 | A1 | 7/2009 | Snell et al. | |

FOREIGN PATENT DOCUMENTS

| | | |
|---|---|---|
| JP | 2001-218872 | 8/2001 |
| JP | 2002-65896 A | 3/2002 |
| WO | WO 96/40378 | 12/1996 |

* cited by examiner

GOLF BALL

This application is a continuation of U.S. application Ser. No. 13/243,777, filed Sep. 23, 2011 now U.S. Pat. No. 8,241,150, which is a continuation of U.S. application Ser. No. 12/378,386, filed Feb. 13, 2009, now issued as U.S. Pat. No. 8,047,933, which claims the benefit of U.S. Provisional Application No. 61/066,438, filed Feb. 19, 2008, and U.S. Provisional Application No. 61/131,562, filed Jun. 9, 2008, all of which are incorporated herein by reference in their entireties.

FIELD OF THE INVENTION

The present invention is a golf ball having a specific arrangement of dimples on the surface which results in improved flight symmetry, and low drag, while maintaining lift at low ball spin rates.

BACKGROUND OF THE INVENTION

The application of synthetic polymer chemistry to the field of sports equipment has revolutionized the performance of athletes in many sports. One sport in which this is particularly true is golf, especially as relates to advances in golf ball performance and ease of manufacture. For instance, the earliest golf balls consisted of a leather cover filled with wet feathers. These "feathery" golf balls were subsequently replaced with a single piece golf ball made from "gutta percha," a naturally occurring rubber-like material. In the early 1900's, the wound rubber ball was introduced, consisting of a solid rubber core around which rubber thread was tightly wound with a gutta percha cover.

Subsequently, new cover materials were discovered and balata was used as the primary material for covers of golf balls until the 1960's when SURLYN®, an ionomeric resin made by E.I. DuPont de Nemours & Co. was introduced to the golf industry. SURLYN® costs less than balata and has a better cut resistance than balata. At the present time, SURLYN® is used as the primary source of cover stock for most two-piece and some three-piece golf balls. The problem with SURLYN®-covered golf balls, however, is that they lack the "click" and "feel" which golfers had become accustomed to with balata. "Click" is the sound made when the ball is hit by a golf club while "feel" is the overall sensation imparted to the golfer when the ball is hit. However, unlike SURLYN®-covered golf balls, polyurethane- or polyurea-covered golf balls can be made to have the "click" and "feel" of balata. Thus premium golf balls today typically exhibit polyurethane or polyurea covers, typically prepared by the reaction of a diisocyanate with a polyol (in the case of polyurethanes) or with a polyamine (in the case of a polyurea). Thermoplastic polyurethanes or polyureas may consist solely of this initial mixture or may be further combined with a chain extender to vary properties such as hardness of the thermoplastic. Thermoset polyurethanes or polyureas typically are formed by the reaction of a diisocyanate and a polyol or polyamine respectively, and an additional crosslinking agent to crosslink or cure the material to result in a thermoset.

In addition to golf ball materials, the construction of the golf ball has evolved over the years. Most modern golf balls can be classified as one-piece, two-piece, and three-piece. One-piece balls are molded from a homogeneous mass of material upon which is molded a dimple pattern. One-piece balls are inexpensive and very durable, but do not provide great distance because of relatively high spin and low velocity. Two-piece balls are made by molding a cover around a solid rubber core. These are the most popular types of balls in use today. In attempts to further modify the ball performance, especially in terms of the distance such balls travel, and the feel transmitted to the golfer through the club on striking the ball, the basic two piece ball construction has been further modified by the introduction of additional layers between the core and outer cover layer. If one additional layer is introduced between the core and outer cover layer, a so called "three-piece ball" results, and similarly, if two additional layers are introduced between the core and outer cover layer, a so called "four-piece ball" results, and so on.

In tandem with the development of golf ball materials and construction, the aerodynamic properties of golf balls have also been the subject of much development. The first golfers in the 1800's realized that gutta-percha golf balls with damaged or indented surfaces flew better than smooth new ones. Subsequently golf balls with brambles (bumps rather than dents), such as the Spalding Agrippa, or with grooves such as the Spalding Silvertown were popular from the late 1800's to 1908. In 1908, William Taylor, patented a golf ball with indentations (dimples) that flew better than golf balls with brambles or grooves. For the next 60 years most balls looked exactly the same having 336 dimples of the same size distributed in an octahedron or so-called Atti pattern over the surface. The ATTI pattern, named after its inventor Ralph Atti, was based on an octahedron, split into eight concentric straight line rows. The only other significant innovation related to the surface of a golf ball during this sixty year period came from Albert Penfold who invented a mesh-pattern golf ball for Dunlop. This pattern was invented in 1912 and was accepted until the 1930's.

In the 1970's, additional dimple patterns were introduced which attempted to maximize the surface coverage of dimples on the ball. For example U.S. Pat. No. 4,949,976 to William Gobush discloses a golf ball with 78% dimple coverage with up to 422 dimples. The 1990's have also seen the dimple surface area coverages increase to up to 80%.

In addition to maximizing surface coverage, recent innovations in dimple pattern design have seen the number of different dimples on a golf ball surface increase both in the variety of their diameters and/or depths. These have included dimple patterns with four or five to as many as eleven different dimple sizes. Additionally, dimple patterns have been based on other sectional shapes, such as pentagonal, as in U.S. Pat. No. 5,201,522, octahedral, dodecahedral and icosahedral patterns or modified versions of these such as in U.S. Pat. No. 4,880,241 which disclose a golf ball dimple pattern having a modified icosahedron pattern.

More recently there have been a number of patents which have attempted to not only maximize surface coverage but also impart selected lift and drag properties for the golf ball. For instance, a drag penalty is often incurred when a single row of deep dimples are placed adjacent to the seam and U.S. Pat. No. 6,066,055 describes how arranging dimple volume differently in (latitudinal) regions is beneficial in producing better ball symmetry, or anisotropy, in flight as compared to a single row of deep dimples near the seam.

Of course the aerodynamic properties imparted by a selected dimple pattern may result in one trajectory for a professional golfer, who would typically have a much higher swing speed than a less accomplished amateur golfer with a slower swing speed. In addition, professional golfers with higher swing speeds also typically impart higher spin on the ball. However to date there is little information on how a given dimple arrangement may be tailored to produce a desired trajectory and which also takes into account the different spin rates imparted to the ball as a result of the golfers swing profile.

This invention offers a dimple design with superior performance in carry distance for golfers whose swing profile generates moderate to low ball spin rates defined here to be from about 1500 rpm to 2600 rpm. This has been achieved by both reducing drag on the overall ball, while increasing lift judiciously. Three separate design features are employed in combination to achieve these results. The first is a method of arranging dimple volume that compensates for seam effects on the ball, the second is reducing total dimple volume (TDV) to the appropriate limit, and the third is selecting a specific dimple volume ratio (VR) with low drag characteristics.

SUMMARY OF THE INVENTION

The present invention is to a golf ball having an equator at latitude 0° and two poles; and an equator region defined by latitudes 0 to 25°, a shoulder region defined by latitudes from more than 25° to less than 65°, and a pole region defined by latitudes 65° to 90°; and a dimple pattern on the surface of the golf ball having an average dimple volume of the equator region Ve, an average dimple volume of the shoulder region, Vs, and an average dimple volume of the pole region, Vp such that the ratio Vs/Ve is less than 0.97 and the ratio Vp/Vs is less than 0.97.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF DRAWINGS

Although FIGS. 5 and 6 illustrate only two- and three-piece golf ball constructions, golf balls of the present invention may comprise from 0 to at least 5 intermediate layer(s), preferably from 0 to 3 intermediate layer(s), more preferably from 1 to 3 intermediate layer(s), and most preferably 1 to 2 intermediate layer(s).

DETAILED DESCRIPTION OF THE INVENTION

Figure 1:
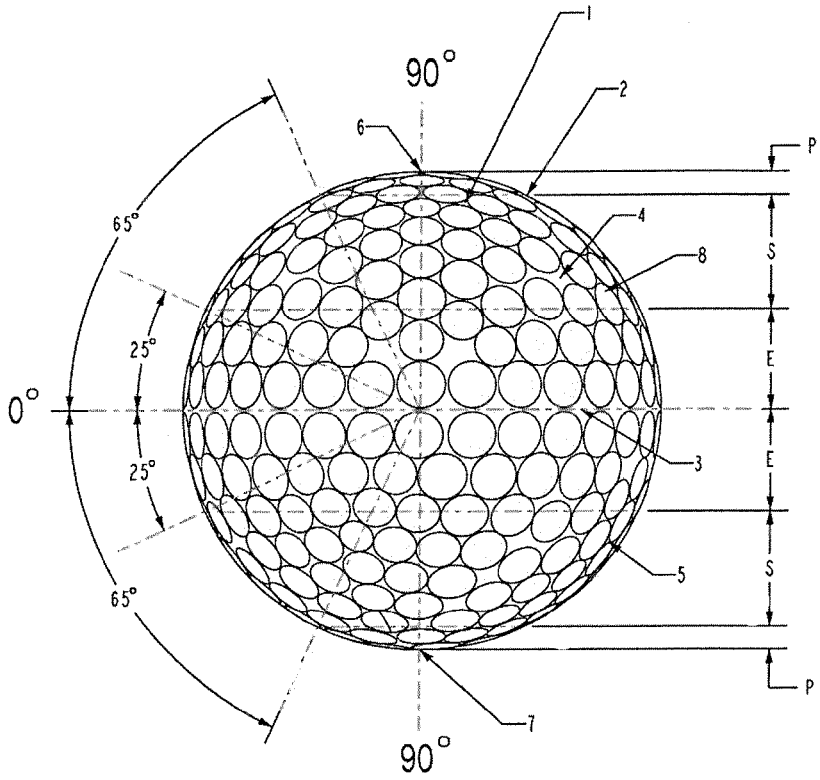
FIG. 1 shows a golf ball, 1, of the present invention in which the ball has an equator or seam 3, two poles 6 and 7, and dimples 8. The equator 3 represent 0° latitude and the pole represent 90° latitude. The region from the equator 3, to 25° latitude is denoted as region E, the region of latitude greater than 25° to less than 65° is region S, and the region of latitude 65° to 90° is region P.

The following definitions are provided to aid the reader, and are not intended to provide term definitions that would be narrower than would be understood by a person of ordinary skill in the art of golf ball composition and manufacture.

Any numerical values recited herein include all values from the lower value to the upper value. All possible combinations of numerical values between the lowest value and the highest value enumerated herein are expressly included in this application.

The term "bimodal polymer" refers to a polymer comprising two main fractions and more specifically to the form of the polymer's molecular weight distribution curve, i.e., the appearance of the graph of the polymer weight fraction as a function of its molecular weight. When the molecular weight distribution curves from these fractions are superimposed onto the molecular weight distribution curve for the total resulting polymer product, that curve will show two maxima or at least be distinctly broadened in comparison with the curves for the individual fractions. Such a polymer product is called bimodal. The chemical compositions of the two fractions may be different.

As used herein, the term "core" is intended to mean the elastic center of a golf ball, which may have a unitary construction. Alternatively the core itself may have a layered construction, e.g., having a spherical "center" and additional "core layers," with such layers being made of the same material or a different material from the core center.

The term "cover" is meant to include any layer of a golf ball that surrounds the core. Thus a golf ball cover may include both the outermost layer and also any intermediate layers, which are disposed between the golf ball center and outer cover layer. "Cover" may be used interchangeably with the term "cover layer."

A "fiber" is a general term and the definition provided by Engineered Materials Handbook, Vol. 2, "Engineering Plastics," published by A.S.M. International, Metals Park, Ohio, USA, is relied upon to refer to filamentary materials with a finite length that is at least 100 times its diameter, which typically is 0.10 to 0.13 mm (0.004 to 0.005 in.). Fibers used in golf ball components are described more fully in Kim et al. U.S. Pat. No. 6,012,991, which is incorporated herein by reference.

The term "induced drag" as used herein means the drag on the ball resulting from the lift generated by its spin, approximated here by 1.5 times the lift coefficient squared.

In the case of a ball with two intermediate layers, the term "inner intermediate layer" may be used interchangeably herein with the terms "inner mantle" or "inner mantle layer" and is intended to mean the intermediate layer of the ball positioned nearest to the core.

The term "intermediate layer" may be used interchangeably with "mantle layer," "inner cover layer" or "inner cover" and is intended to mean any layer(s) in a golf ball disposed between the core and the outer cover layer.

The term "(meth)acrylate" is intended to mean an ester of methacrylic acid and/or acrylic acid.

The term "(meth)acrylic acid copolymers" is intended to mean copolymers of methacrylic acid and/or acrylic acid.

A "nanofiller" is defined as a material having an aggregate structure with the aggregate particle sizes in the micron range and above. However, these aggregates have a stacked plate structure with the individual platelets being roughly from about 1 nanometer (nm) thick and from about 100 to about 1000 nm across.

A "nanocomposite" is defined as a polymer matrix having nanofiller within the matrix. Nanocomposite materials and golf balls made comprising nanocomposite materials are disclosed in Kim et al., U.S. Pat. No. 6,794,447, and U.S. Patent Publication No. 2005/0059756 A1, as well as U.S. Pat. Nos. 5,962,553 to Ellsworth, 5,385,776 to Maxfield et al., and 4,894,411 to Okada et al., the disclosure of each of which are incorporated herein by reference in their entirety. Examples of nanocomposite materials currently marketed include M1030D, manufactured by Unitika Limited, of Osaka, Japan, and 1015C2, manufactured by UBE America of New York, N.Y.

The term "outer cover layer" is intended to mean the outermost cover layer of the golf ball on which, for example, the dimple pattern, paint and any writing, symbol, etc. is placed. If, in addition to the core, a golf ball comprises two or more cover layers, only the outermost layer is designated the outer cover layer. The remaining layers may be designated intermediate layers. The term outer cover layer is interchangeable with the term "outer cover."

In the case of a ball with two intermediate layers, the term "outer intermediate layer" may be used interchangeably herein with the terms "outer mantle" or "outer mantle layer" and is intended to mean the intermediate layer of the ball which is disposed nearest to the outer cover layer.

The term "parasite drag" as used herein means the total drag on the ball minus the induced drag.

The term "polyurea" as used herein refers to materials prepared by reaction of a diisocyanate with a polyamine.

The term "polyurethane" as used herein refers to materials prepared by reaction of a diisocyanate with a polyol.

A "thermoplastic" is generally defined as a material that is capable of softening or melting when heated and of hardening again when cooled. Thermoplastic polymer chains often are not cross-linked or are lightly crosslinked using a chain extender, but the term "thermoplastic" as used herein may refer to materials that initially act as thermoplastics, such as during an initial extrusion process or injection molding process, but which also may be crosslinked, such as during a compression molding step to form a final structure.

A "thermoset" is generally defined as a material that crosslinks or cures via interaction with as crosslinking or curing agent. The crosslinking may be brought about by energy in the form of heat (generally above 200 degrees Celsius), through a chemical reaction (by reaction with a curing agent), or by irradiation. The resulting composition remains rigid when set, and does not soften with heating. Thermosets have this property because the long-chain polymer molecules cross-link with each other to give a rigid structure. A thermoset material cannot be melted and remolded after it is cured thus thermosets do not lend themselves to recycling unlike thermoplastics, which can be melted and re-molded.

The term "unimodal polymer" refers to a polymer comprising one main fraction and more specifically to the form of the polymer's molecular weight distribution curve, i.e., the molecular weight distribution curve for the total polymer product shows only a single maximum.

The present invention can be used to form golf balls of any desired size. "The Rules of Golf" by the USGA dictate that the size of a competition golf ball must be at least 1.680 inches in diameter; however, golf balls of any size can be used for leisure golf play. The preferred diameter of the golf balls is from about 1.670 inches to about 1.800 inches. Oversize golf balls with diameters above about 1.760 inches to as big as 2.75 inches also are within the scope of the invention.

As shown in FIG. 1, a golf ball is generally designated 1. The golf ball may be a one-piece, two-piece, a three piece, or the like golf ball. Further, the three-piece golf ball may have a wound layer, or a solid boundary layer. The cover of the golf ball 2 may be any suitable material. A preferred cover is composed of a thermoset polyurethane material. However, those skilled in the pertinent art will recognize that other cover materials may be utilized without departing from the scope and spirit of the present invention. The golf ball 1 may have a finish of a basecoat and/or top coat.

The golf ball 1 has an equator or parting line 3 dividing the golf ball 1 into a first hemisphere 4 and a second hemisphere 5. A first pole 6 is located ninety degrees along a longitudinal arc from the equator 3 in the first hemisphere 4. A second pole 7 is located ninety degrees along a longitudinal arc from the equator 3 in the second hemisphere 5.

Dimples 8 which can have varying depths, diameters, volumes, and shapes are then placed on the ball surface as described in more detail herein.

An equatorial zone E is then defined as the equator area on the ball surface occurring between latitudes 0 to 25° in hemisphere 4 as well as the second hemisphere 5. Similarly, the shoulder zone S is defined as the shoulder area on the ball surface occurring between latitudes greater than 25° to less than 65° in each hemisphere, finally zone P is defined as the pole areas on the ball defined by latitudes from 65° to 90° in each hemisphere.

The average dimple volume in a region is calculated by summing the total chordal dimple volume of all dimples whose center resides in the region divided by the number of dimples whose center also resides in said region. The total chordal dimple volume in each region P, S, and E is denoted by Tp, Ts, and Te, and the number of dimples in the same regions are denoted by Np, Ns, and Ne respectively. The average dimple volume in regions P, S, and E are given by Vp, Vs, and Ve, where Vp=Tp/Np, Vs=Ts/Ns, and Ve=Te/Ne. For the golf balls of the present invention, the ratio Vs/Ve is less than 0.97, preferably less than 0.94, more preferably less than 0.90. For the golf balls of the present invention, the ratio Vp/Vs is less than 0.97, preferably less than 0.94, more preferably less than 0.90.

The total chordal dimple volume, denoted here by TDV, is the sum of all the chordal volumes, Tp, Ts, and Te over the entire ball. This invention does not use a single row of deep dimples around the equator, but varies dimple volume from equator to pole. The net effect is a ball with good flight symmetry and lower drag, relative to the case of a single row of deep dimples. Typically the dimples near the pole are about 10% more shallow, and the dimples near the equator are about 5% deeper than the same design with no depth progression. The dimples between the pole and equator are adjusted so that the transition in dimple volume is smooth from pole to equator. In order to keep the overall peak height of the ball the same, the total change to the TDV is minimal. The overall drag on the ball is reduced further by keeping the dimples as shallow as possible. The fact that shallow dimples have less drag was applied to this invention by reducing the TDV across the entire ball. A side effect of this is increased lift, so the TDV is only reduced enough such that flight characteristics are not penalized significantly.

The TDV should be between 370 and 385, preferably between 372 and 383, more preferably between 375 and 380 $mm^3$. If TDV is less than 370 $mm^3$ the ball may loose lift prematurely late in flight, or possibly balloon in flight if TDV is too low. If the TDV is greater than 385 $mm^3$ then the ball does not have superior carry performance for low spin rates, less then 2600 rpm, and typically has higher drag.

The dimple volume ratio, defined by dimple chordal volume divided by the volume of a cylinder with the same diameter and depth as the dimple, is set to a value of 0.55. This volume ratio was found to have superior lift and drag characteristics. According to certain embodiments, the dimple volume ratio may be 0.50 to 0.58.

The combination of these features produces good carry distance performance at low and medium spin rates simultaneously.

According to certain embodiments, the golf balls disclosed herein also meet the symmetry standards set forth by the U.S.G.A. (see section 7.3). The symmetry standards are determined by calculating the differences between the carry distances and time of flight for each ball in the two orientations (PP—poles over pole and PH—poles over horizontal) and computing the mean of these differences. The symmetry standards are satisfied if the mean of the differences in the carry distance is not greater 4.0 yards and the mean of the differences in the time of flight is not more than 0.40 seconds.

Polymeric materials generally considered useful for making golf balls according to the process of the present invention may also be included in the components of the golf balls of the present invention and these include, without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamer, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic copolymers, functionalized styrenic copolymers, functionalized styrenic terpolymers, styrenic terpolymers, cellulosic polymers, liquid crystal polymers (LCP), ethylene-propylene-diene terpolymers (EPDM), ethylene-vinyl acetate copolymers (EVA), ethylene-propylene copolymers, ethylene vinyl acetates, polyureas, and polysiloxanes and any and all combinations thereof.

More specific examples of particular polymeric materials useful for making golf ball cores, optional intermediate layer(s) and outer covers, again without limitation, are provided below.

A most preferred polymeruic material for the golf ball of the present invention is a polyurea or polyurethane, prepared by combining a diisocyanate with either a polyamine or polyol respectively, and one or more chain extenders (in the case of a thermoplastic polyurea or polyurethane) or curing agents (in the case of a thermoset polyurea or polyurethane) The final composition may advantageously be employed as an intermediate layer in a golf ball and even more advantageously as an outer cover layer.

Any isocyanate available to one of ordinary skill in the art is suitable for use according to the invention. Isocyanates for use with the present invention include, but are not limited to, aliphatic, cycloaliphatic, aromatic aliphatic, aromatic, any derivatives thereof, and combinations of these compounds having two or more isocyanate (NCO) groups per molecule. As used herein, aromatic aliphatic compounds should be understood as those containing an aromatic ring, wherein the isocyanate group is not directly bonded to the ring. One example of an aromatic aliphatic compound is a tetramethylene diisocyanate (TMXDI). The isocyanates may be organic polyisocyanate-terminated prepolymers, low free isocyanate prepolymer, and mixtures thereof. The isocyanate-containing reactable component may also include any isocyanate-functional monomer, dimer, trimer, or polymeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic, aromatic, or linear or branched hydrocarbon moiety containing from about 1 to about 50 carbon atoms. The isocyanate may also contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof.

Examples of isocyanates that can be used with the present invention include, but are not limited to, substituted and isomeric mixtures including 2,2'-, 2,4'-, and 4,4'-diphenylmethane diisocyanate (MDI); 3,3'-dimethyl-4,4'-biphenylene diisocyanate (TODI); toluene diisocyanate (TDI); polymeric MDI; carbodiimide-modified liquid 4,4'-diphenylmethane diisocyanate; para-phenylene diisocyanate (PPDI); meta-phenylene diisocyanate (MPDI); triphenyl methane-4,4'- and triphenyl methane-4,4"-triisocyanate; naphthylene-1,5-diisocyanate; 2,4'-, 4,4'-, and 2,2-biphenyl diisocyanate; polyphenylene polymethylene polyisocyanate (PMDI) (also known as polymeric PMDI); mixtures of MDI and PMDI; mixtures of PMDI and TDI; ethylene diisocyanate; propylene-1,2-diisocyanate; trimethylene diisocyanate; butylenes diisocyanate; bitolylene diisocyanate; tolidine diisocyanate; tetramethylene-1,2-diisocyanate; tetramethylene-1,3-diisocyanate; tetramethylene-1,4-diisocyanate; pentamethylene diisocyanate; 1,6-hexamethylene diisocyanate (HDI); octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; diethylidene diisocyanate; methylcyclohexylene diisocyanate (HTDI); 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl)dicyclohexane; isophorone diisocyanate (IPDI); dimeryl diisocyanate, dodecane-1,12-diisocyanate, 1,10-decamethylene diisocyanate, cyclohexylene-1,2-diisocyanate, 1,10-decamethylene diisocyanate, 1-chlorobenzene-2,4-diisocyanate, furfurylidene diisocyanate, 2,4,4-trimethyl hexamethylene diisocyanate, 2,2,4-trimethyl hexamethylene diisocyanate, dodecamethylene diisocyanate, 1,3-cyclopentane diisocyanate, 1,3-cyclohexane diisocyanate, 1,3-cyclobutane diisocyanate, 1,4-cyclohexane diisocyanate, 4,4'-methylenebis(cyclohexyl isocyanate), 4,4'-methylenebis(phenyl isocyanate), 1-methyl-2,4-cyclohexane diisocyanate, 1-methyl-2,6-cyclohexane diisocyanate, 1,3-bis(isocyanato-methyl)cyclohexane, 1,6-diisocyanato-2,2,4,4-tetra-methylhexane, 1,6-diisocyanato-2,4,4-tetra-trimethylhexane, trans-cyclohexane-1,4-diisocyanate, 3-isocyanato-methyl-3,5,5-trimethylcyclohexyl isocyanate, 1-isocyanato-3,3,5-trimethyl-5-isocyanatomethylcyclohexane, cyclo-hexyl isocyanate, dicyclohexylmethane 4,4'-diisocyanate, 1,4-bis(isocyanatomethyl)cyclohexane, m-phenylene diisocyanate, m-xylylene diisocyanate, m-tetramethylxylylene diisocyanate, p-phenylene diisocyanate, p,p'-biphenyl diisocyanate, 3,3'-dimethyl-4,4'-biphenylene diisocyanate, 3,3'-dimethoxy-4,4'-biphenylene diisocyanate, 3,3'-diphenyl-4,4'-biphenylene diisocyanate, 4,4'-biphenylene diisocyanate, 3,3'-dichloro-4,4'-biphenylene diisocyanate, 1,5-naphthalene diisocyanate, 4-chloro-1,3-phenylene diisocyanate, 1,5-tetrahydronaphthalene diisocyanate, metaxylene diisocyanate, 2,4-toluene diisocyanate, 2,4'-diphenylmethane diisocyanate, 2,4-chlorophenylene diisocyanate, 4,4'-diphenylmethane diisocyanate, p,p'-diphenylmethane diisocyanate, 2,4-tolylene diisocyanate, 2,6-tolylene diisocyanate, 2,2-diphenylpropane-4,4'-diisocyanate, 4,4'-toluidine diisocyanate, dianidine diisocyanate, 4,4'-diphenyl ether diisocyanate, 1,3-xylylene diisocyanate, 1,4-naphthylene diisocyanate, azobenzene-4,4'-diisocyanate, diphenyl sulfone-4,4'-diisocyanate, triphenylmethane 4,4',4"-triisocyanate, isocyanatoethyl methacrylate, 3-isopropenyl-α,α-dimethylbenzyl-isocyanate, dichlorohexamethylene diisocyanate, ω,ω'-diisocyanato-1,4-diethylbenzene, polymethylene polyphenylene polyisocyanate, isocyanurate modified compounds, and carbodiimide modified compounds, as well as biuret modified compounds of the above polyisocyanates. These isocyanates may be used either alone or in combination. These combination isocyanates include triisocyanates, such as biuret of hexamethylene diisocyanate and triphenylmethane triisocyanates, and polyisocyanates, such as polymeric diphenylmethane diisocyanate.triisocyanate of HDI; triisocyanate of 2,2,4-trimethyl-1,6-hexane diisocyanate (TMDI); 4,4'-dicyclohexylmethane diisocyanate ($H_{12}$MDI); 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; meta-tetramethylxylene diisocyanate (m-TMXDI); para-tetramethylxylene diisocyanate (p-TMXDI); trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, and mixtures thereof, dimerized uretdione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

Any polyol available to one of ordinary skill in the polyurethane art is suitable for use according to the invention. Polyols suitable for use in the reduced-yellowing compositions of the present invention include, but are not limited to, polyester polyols, polyether polyols, polycarbonate polyols and polydiene polyols such as polybutadiene polyols.

Polyester polyols are prepared by condensation or step-growth polymerization utilizing diacids. Primary diacids for polyester polyols are adipic acid and isomeric phthalic acids. Adipic acid is used for materials requiring added flexibility, whereas phthalic anhydride is used for those requiring rigidity. Some examples of polyester polyols include poly(ethylene adipate) (PEA), poly(diethylene adipate) (PDA), poly(propylene adipate) (PPA), poly(tetramethylene adipate) (PBA), poly(hexamethylene adipate) (PHA), poly(neopentylene adipate) (PNA), polyols composed of 3-methyl-1,5-pentanediol and adipic acid, random copolymer of PEA and PDA, random copolymer of PEA and PPA, random copolymer of PEA and PBA, random copolymer of PHA and PNA, caprolactone polyol obtained by the ring-opening polymerization of ε-caprolactone, and polyol obtained by opening the ring of β-methyl-δ-valerolactone with ethylene glycol can be used either alone or in a combination thereof. Additionally, polyester polyol may be composed of a copolymer of at least one of the following acids and at least one of the following glycols. The acids include terephthalic acid, isophthalic acid, phthalic anhydride, oxalic acid, malonic acid, succinic acid, pentanedioic acid, hexanedioic acid, octanedioic acid, nonanedioic acid, adipic acid, azelaic acid, sebacic acid, dodecanedioic acid, dimer acid (a mixture), ρ-hydroxybenzoate, trimellitic anhydride, ε-caprolactone, and β-methyl-δ-valerolactone. The glycols includes ethylene glycol, propylene glycol, butylene glycol, pentylene glycol, 1,4-butanediol, 1,5-pentanediol, 1,6-hexanediol, neopentylene glycol, polyethylene glycol, polytetramethylene glycol, 1,4-cyclohexane dimethanol, pentaerythritol, and 3-methyl-1,5-pentanediol.

Polyether polyols are prepared by the ring-opening addition polymerization of an alkylene oxide (e.g. ethylene oxide and propylene oxide) with an initiator of a polyhydric alcohol (e.g. diethylene glycol), which is an active hydride. Specifically, polypropylene glycol (PPG), polyethylene glycol (PEG) or propylene oxide-ethylene oxide copolymer can be obtained. Polytetramethylene ether glycol (PTMG) is prepared by the ring-opening polymerization of tetrahydrofuran, produced by dehydration of 1,4-butanediol or hydrogenation of furan. Tetrahydrofuran can form a copolymer with alkylene oxide. Specifically, tetrahydrofuran-propylene oxide copolymer or tetrahydrofuran-ethylene oxide copolymer can be formed. The polyether polyol may be used either alone or in a combination.

Polycarbonate polyol is obtained by the condensation of a known polyol (polyhydric alcohol) with phosgene, chloroformic acid ester, dialkyl carbonate or diallyl carbonate. Particularly preferred polycarbonate polyol contains a polyol component using 1,6-hexanediol, 1,4-butanediol, 1,3-butanediol, neopentylglycol or 1,5-pentanediol. Polycarbonate polyols can be used either alone or in a combination with other polyols.

Polydiene polyol includes liquid diene polymer containing hydroxyl groups having an average of at least 1.7 functional groups, and may be composed of diene polymer or diene copolymer having 4 to 12 carbon atoms, or a copolymer of such diene with addition to polymerizable α-olefin monomer having 2 to 2.2 carbon atoms. Specific examples include butadiene homopolymer, isoprene homopolymer, butadiene-styrene copolymer, butadiene-isoprene copolymer, butadiene-acrylonitrile copolymer, butadiene-2-ethyl hexyl acrylate copolymer, and butadiene-n-octadecyl acrylate copolymer. These liquid diene polymers can be obtained, for example, by heating a conjugated diene monomer in the presence of hydrogen peroxide in a liquid reactant.

Polybutadiene polyol includes liquid diene polymer containing hydroxyl groups having an average of at least 1.7 functional groups, and may be composed of diene polymer or diene copolymer having 4 to 12 carbon atoms, or a copolymer of such diene with addition to polymerizable α-olefin monomer having 2 to 2.2 carbon atoms. Specific examples include butadiene homopolymer, isoprene homopolymer, butadiene-styrene copolymer, butadiene-isoprene copolymer, butadiene-acrylonitrile copolymer, butadiene-2-ethyl hexyl acrylate copolymer, and butadiene-n-octadecyl acrylate copolymer. These liquid diene polymers can be obtained, for example, by heating a conjugated diene monomer in the presence of hydrogen peroxide in a liquid reactant.

Any polyamine available to one of ordinary skill in the polyurethane art is suitable for use according to the invention. Polyamines suitable for use in the reduced-yellowing compositions of the present invention include, but are not limited to, The amine-terminated compound is selected from the group consisting of amine-terminated hydrocarbons, amine-terminated polyethers, amine-terminated polyesters, amine-terminated polycaprolactones, amine-terminated polycarbonates, amine-terminated polyamides, and mixtures thereof. The amine-terminated compound may be a polyether amine selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof.

The previously described diisocyante and polyol or polyamine components may be previously combined to form a prepolymer prior to reaction with the chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, LFG640D.

One preferred prepolymer is a toluene diisocyanate prepolymer with polypropylene glycol. Such polypropylene glycol terminated toluene diisocyanate prepolymers are available from Uniroyal Chemical Company of Middlebury, Conn., under the trade name ADIPRENE® LFG963A and LFG640D. Most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

In one embodiment, the number of free NCO groups in the urethane or urea prepolymer may be less than about 14 percent. Preferably the urethane or urea prepolymer has from about 3 percent to about 11 percent, more preferably from about 4 to about 9.5 percent and even more preferably from about 3 percent to about 9 percent free NCO on an equivalent weight basis.

In view of the aforementioned advantages of injection molding versus the more complex casting process, under some circumstances it is advantageous to have formulations which are able to cure as a thermoset but only within a specified temperature range which is above that of the typical injection molding process. This allows parts, such as golf ball cover layers, to be initially injection molded, followed by subsequent processing at higher temperatures and pressures to induce further crosslinking and curing, resulting in thermoset properties in the final part. Such an initially injection moldable composition is thus called a post curable urethane or urea composition.

If a post curable polyurea or polyurethane composition is required, a modified or blocked diisocyanate which subsequently unblocks and induces further cross linking post extrusion may be included in the diisocyanate starting material. Such a system is disclosed by Kim et al in U.S. Pat. No. 6,939,924, the entire contents of which are hereby incorporated by reference. Alternatively, a thermoplastic urethane or urea composition further comprising a peroxide or peroxide mixture, can then under post curing to result in a thermoset. Such a system is disclosed by Kim in U.S. Pat. No. 6,924,337, the entire contents of which are hereby incorporated by reference. Finally the thermoplastic urethane or urea compositions may further comprising a reaction product of a nitroso compound and a diisocyanate or a polyisocyanate to induce further cross linking post extrusion may be included in the diisocyanate starting material Such a system is disclosed by Kim et al in U.S. Pat. No. 7,037,985 B2, the entire contents of which are hereby incorporated by reference.

Because the polyureas or polyurethanes used to make the covers of such golf balls generally contain an aromatic component, e.g., aromatic diisocyanate, polyol, or polyamine, they are susceptible to discoloration upon exposure to light, particularly ultraviolet (UV) light. To slow down the discoloration, light and UV stabilizers, e.g., TINUVIN® 770, 765, and 328, are added to these aromatic polymeric materials. In addition, non-aromatic components may be used to minimize this discoloration, one example of which is described in copending U.S. patent application Ser. No. 11/809,432, filed on May 31, 2007, the entire contents of which are hereby incorporated by reference.

The, outer cover and/or one or intermediate layers of the golf ball may also comprise one or more ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer." The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with the $Li^+$, $Na^+$, $Ca^{2+}$, $Zn^{2+}$, and $Mg^{2+}$ being preferred. The basic metal ion salts include those of for example formic acid, acetic acid, nitric acid, and carbonic acid, hydrogen carbonate salts, oxides, hydroxides, and alkoxides.

The first commercially available ionomer resins contained up to 16 weight percent acrylic or methacrylic acid, although it was also well known at that time that, as a general rule, the hardness of these cover materials could be increased with increasing acid content. Hence, in Research Disclosure 29703, published in January 1989, DuPont disclosed ionomers based on ethylene/acrylic acid or ethylene/methacrylic acid containing acid contents of greater than 15 weight percent. In this same disclosure, DuPont also taught that such so called "high acid ionomers" had significantly improved stiffness and hardness and thus could be advantageously used in golf ball construction, when used either singly or in a blend with other ionomers.

More recently, high acid ionomers can be ionomer resins with acrylic or methacrylic acid units present from 16 wt. % to about 35 wt. % in the polymer. Generally, such a high acid ionomer will have a flexural modulus from about 50,000 psi to about 125,000 psi.

Ionomer resins further comprising a softening comonomer, present from about 10 wt. % to about 50 wt. % in the polymer, have a flexural modulus from about 2,000 psi to about 10,000 psi, and are sometimes referred to as "soft" or "very low modulus" ionomers. Typical softening comonomers include n-butyl acrylate, iso-butyl acrylate, n-butyl methacrylate, methyl acrylate and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf ball component. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ α,β ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said ionomeric polymer are partially neutralized with a metal selected from the group consisting of lithium, sodium, potassium, magnesium, calcium, barium, lead, tin, zinc or aluminum, and combinations thereof.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights. Specifically they include bimodal polymer blend compositions comprising:

a) a high molecular weight component having molecular weight of about 80,000 to about 500,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said high molecular weight component being partially neutralized with metal ions selected from the group consisting of lithium, sodium, zinc, calcium, magnesium, and a mixture of any these; and b) a low molecular weight component having a molecular weight of about from about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and a mixture of any these.

In addition to the unimodal and bimodal ionomers, also included are the so-called "modified ionomers" examples of which are described in U.S. Pat. Nos. 6,100,321, 6,329,458 and 6,616,552 and U.S. Patent Publication No. US 2003/0158312 A1, the entire contents of all of which are herein incorporated by reference.

The modified unimodal ionomers may be prepared by mixing:

a) an ionomeric polymer comprising ethylene, from 5 to 25 weight percent (meth)acrylic acid, and from 0 to 40 weight percent of a (meth)acrylate monomer, said ionomeric polymer neutralized with metal ions selected from the group consisting of lithium, sodium, potassium, magnesium, calcium, barium, lead, tin, zinc or aluminum, and any and all mixtures thereof; and b) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

The modified bimodal ionomers, which are ionomers derived from the earlier described bimodal ethylene/carboxylic acid polymers (as described in U.S. Pat. No. 6,562,906, the entire contents of which are herein incorporated by reference), are prepared by mixing;

a) a high molecular weight component having molecular weight of about 80,000 to about 500,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said high molecular weight component being partially neutralized with metal ions selected from the group consisting of lithium, sodium, potassium, magnesium, calcium, barium, lead, tin, zinc or aluminum, and any and all mixtures thereof; and b) a low molecular weight component having a molecular weight of about from about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and any and all mixtures thereof; and c) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

The fatty or waxy acid salts utilized in the various modified ionomers are composed of a chain of alkyl groups containing from about 4 to 75 carbon atoms (usually even numbered) and characterized by a —COOH terminal group. The generic formula for all fatty and waxy acids above acetic acid is $CH_3(CH_2)_xCOOH$, wherein the carbon atom count includes the carboxyl group (i.e. x=2-73). The fatty or waxy acids utilized to produce the fatty or waxy acid salts modifiers may be saturated or unsaturated, and they may be present in solid, semi-solid or liquid form.

Examples of suitable saturated fatty acids, i.e., fatty acids in which the carbon atoms of the alkyl chain are connected by single bonds, include but are not limited to stearic acid ($C_{18}$, i.e., $CH_3(CH_2)_{16}COOH$), palmitic acid ($C_{16}$, i.e., $CH_3(CH_2)_{14}COOH$), pelargonic acid ($C_9$, i.e., $CH_3(CH_2)_7COOH$) and lauric acid ($C_{12}$, i.e., $CH_3(CH_2)_{10}OCOOH$). Examples of suitable unsaturated fatty acids, i.e., a fatty acid in which there are one or more double bonds between the carbon atoms in the alkyl chain, include but are not limited to oleic acid ($C_{13}$, i.e., $CH_3(CH_2)_7CH{:}CH(CH_2)_7COOH$).

The source of the metal ions used to produce the metal salts of the fatty or waxy acid salts used in the various modified ionomers are generally various metal salts which provide the metal ions capable of neutralizing, to various extents, the carboxylic acid groups of the fatty acids. These include the sulfate, carbonate, acetate and hydroxylate salts of zinc, barium, calcium and magnesium.

Since the fatty acid salts modifiers comprise various combinations of fatty acids neutralized with a large number of different metal ions, several different types of fatty acid salts may be utilized in the invention, including metal stearates, laureates, oleates, and palmitates, with calcium, zinc, sodium, lithium, potassium and magnesium stearate being preferred, and calcium and sodium stearate being most preferred.

The fatty or waxy acid or metal salt of said fatty or waxy acid is present in the modified ionomeric polymers in an amount of from about 5 to about 40, preferably from about 7 to about 35, more preferably from about 8 to about 20 weight percent (based on the total weight of said modified ionomeric polymer).

As a result of the addition of the one or more metal salts of a fatty or waxy acid, from about 40 to 100, preferably from about 50 to 100, more preferably from about 70 to 100 percent of the acidic groups in the final modified ionomeric polymer composition are neutralized by a metal ion. An example of such a modified ionomer polymer is DuPont® HPF-1000 available from E. I. DuPont de Nemours and Co. Inc.

A preferred ionomer composition may be prepared by blending one or more of the unimodal ionomers, bimodal ionomers, or modified unimodal or bimodal ionomeric polymers as described herein, and further blended with a zinc neutralized ionomer of a polymer of general formula E/X/Y where E is ethylene, X is a softening comonomer such as acrylate or methacrylate and is present in an amount of from 0 to about 50, preferably 0 to about 25, most preferably 0, and Y is acrylic or methacrylic acid and is present in an amount from about 5 wt. % to about 25, preferably from about 10 to about 25, and most preferably about 10 to about 20 wt % of the total composition.

The outer cover and/or one or intermediate layers of the golf ball may also comprise one or more polyamider resins. Illustrative polyamides for use in the golf balls disclosed include those obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, decamethylenediamine, 1,4-cyclohexyldiamine or m-xylylenediamine; (2) a ring-opening polymerization of cyclic lactam, such as ϵ-caprolactam or ω-laurolactam; (3) polycondensation of an aminocarboxylic acid, such as 6-aminocaproic acid, 9-aminononanoic acid, 11-aminoundecanoic acid or 12-aminododecanoic acid; (4) copolymerization of a cyclic lactam with a dicarboxylic acid and a diamine; or any combination of (1)-(4). In certain examples, the dicarboxylic acid may be an aromatic dicarboxylic acid or a cycloaliphatic dicarboxylic acid. In certain examples, the diamine may be an aromatic diamine or a cycloaliphatic diamine. Specific examples of suitable polyamides include polyamide 6; polyamide 11; polyamide 12; polyamide 4,6; polyamide 6,6; polyamide 6,9; polyamide 6,10; polyamide 6,12; polyamide MXD6; PA12, CX; PA12, IT; PPA; PA6, IT; and PA6/PPE.

The polyamide may be any homopolyamide or copolyamide. One example of a group of suitable polyamides is thermoplastic polyamide elastomers. Thermoplastic polyamide elastomers typically are copolymers of a polyamide and polyester or polyether. For example, the thermoplastic polyamide elastomer can contain a polyamide (Nylon 6, Nylon 66, Nylon 11, Nylon 12 and the like) as a hard segment and a polyether or polyester as a soft segment. In one specific example, the thermoplastic polyamides are amorphous copolyamides based on polyamide (PA 12).

Examples of copolyester thermoplastic elastomers include polyether ester block copolymers, polylactone ester block copolymers, and aliphatic and aromatic dicarboxylic acid copolymerized polyesters. Polyether ester block copolymers are copolymers comprising polyester hard segments polymerized from a dicarboxylic acid and a low molecular weight diol, and polyether soft segments polymerized from an alkylene glycol having 2 to 10 atoms. Polylactone ester block copolymers are copolymers having polylactone chains instead of polyether as the soft segments discussed above for polyether ester block copolymers. Aliphatic and aromatic dicarboxylic copolymerized polyesters are copolymers of an acid component selected from aromatic dicarboxylic acids, such as terephthalic acid and isophthalic acid, and aliphatic acids having 2 to 10 carbon atoms with at least one diol component, selected from aliphatic and alicyclic diols having 2 to 10 carbon atoms. Blends of aromatic polyester and aliphatic polyester also may be used for these. Examples of these include products marketed under the trade names HYTREL by E.I. DuPont de Nemours & Company, and SKYPEL by S.K. Chemicals. The polyether block comprises different units such as units which derive from ethylene glycol, propylene glycol, or tetramethylene glycol.

One type of polyetherester elastomer is the family of Pebax, which are available from Elf-Atochem Company. Preferably, the choice can be made from among Pebax 2533, 3533, 4033, 1205, 7033 and 7233. Some examples of suitable polyamides for use include those commercially available under the trade names PEBAX, CRISTAMID and RILSAN marketed by Atofina Chemicals of Philadelphia, Pa., GRIVORY and GRILAMID marketed by EMS Chemie of Sumter, S.C., TROGAMID and VESTAMID available from Degussa, and ZYTEL marketed by E.I. DuPont de Nemours & Co., of Wilmington, Del.
of Seoul, South Korea.

Examples of other thermoplastic elastomers suitable as additional polymer components in the present invention include those having functional groups, such as carboxylic acid, maleic anhydride, glycidyl, norbonene, and hydroxyl functionalities. An example of these includes a block polymer having at least one polymer block A comprising an aromatic vinyl compound and at least one polymer block B comprising a conjugated diene compound, and having a hydroxyl group at the terminal block copolymer, or its hydrogenated product. An example of this polymer is sold under the trade name SEPTON HG-252 by Kuraray Company of Kurashiki, Japan. In yet another embodiment, a blend of an ionomer and a block copolymer can be included A preferred block copolymer is SEPTON HG-252. Such blends are described in more detail in commonly-assigned U.S. Pat. No. 6,861,474 and U.S. Patent Publication No. 2003/0224871 both of which are incorporated herein by reference in their entireties.

In a further embodiment, the core, mantle and/or cover layers (and particularly the outer cover layer) of the golf balls of the present invention can comprise a composition prepared by blending together at least three materials, identified as Components A, B, and C, and melt-processing these components to form in-situ, a polymer blend composition incorporating a pseudo-crosslinked polymer network. The first of these blend components (blend Component A) include block copolymers including di and triblock copolymers, incorporating a first polymer block having an aromatic vinyl compound, and a second polymer block having an olefinic and/or conjugated diene compound. Preferred aromatic vinyl compounds include styrene, α-methylstyrene, o-, m- or p-methylstyrene, 4-propylstyrene, 1,3-dimethylstyrene, vinylnaphthalene and vinylanthracene. In particular, styrene and α-methylstyrene are preferred. These aromatic vinyl compounds can each be used alone, or can be used in combination of two or more kinds. The aromatic vinyl compound is preferably contained in the block copolymer in an amount of from 5 to 75% by weight, and more preferably from 10 to 65% by weight.

The conjugated diene compound, that constitutes the second polymer block in the block copolymer, includes, e.g., 1,3-butadiene, isoprene, 2,3-dimethyl-1,3-butadiene, 1,3-pentadiene and 1,3-hexadiene. In particular, isoprene and 1,3-butadiene are preferred. These conjugated diene compounds can each be used alone, or can be used in combination of two or more kinds. Preferred block copolymers include the styrenic block copolymers such as styrene-butadiene-styrene (SBS), styrene-ethylene-butylene-styrene, (SEBS) and styrene-ethylene/propylene-styrene (SEPS). Commercial examples include SEPTON marketed by Kuraray Company of Kurashiki, Japan; TOPRENE by Kumho Petrochemical Co., Ltd and KRATON marketed by Kraton Polymers.

The second blend component, Component B, is an acidic polymer that incorporates at least one type of an acidic functional group. Examples of such polymers suitable for use as include, but are not limited to, ethylene/(meth)acrylic acid copolymers and ethylene/(meth)acrylic acid/alkyl(meth) acrylate terpolymers, or ethylene and/or propylene maleic anhydride copolymers and terpolymers. Examples of such polymers which are commercially available include, but are not limited to, the Escor® 5000, 5001, 5020, 5050, 5070, 5100, 5110 and 5200 series of ethylene-acrylic acid copolymers sold by Exxon Mobil, the PRIMACOR® 1321, 1410, 1410-XT, 1420, 1430, 2912, 3150, 3330, 3340, 3440, 3460, 4311, 4608 and 5980 series of ethylene-acrylic acid copolymers sold by The Dow Chemical Company, Midland, Mich. and the ethylene-methacrylic acid copolymers such as Nucrel 599, 699, 0903, 0910, 925, 960, 2806, and 2906 sold by DuPont.

Also included are the so called bimodal ethylene/carboxylic acid polymers as described in U.S. Pat. No. 6,562,906, the contents of which are incorporated herein by reference. These polymers comprise a first component comprising an ethylene/α,β-ethylenically unsaturated $C_{3-8}$ carboxylic acid high copolymer, particularly ethylene(meth)acrylic acid copolymers and ethylene, alkyl(meth)acrylate, (meth)acrylic acid terpolymers, having a weight average molecular weight, Mw, of about 80,000 to about 500,000, and a second component comprising an ethylene/α,β-ethylenically unsaturated $C_{3-8}$ carboxylic acid copolymers, particularly ethylene/(meth) acrylic acid copolymers having weight average molecular weight, Mw, of about 2,000 to about 30,000.

Component C is a base capable of neutralizing the acidic functional group of Component B and typically is a base having a metal cation. These metals are from groups IA, IB, IIA, IIB, IIIA, IIIB, IVA, IVB, VA, VB, VIIA, VIIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal oxides, metal carbonates, metal acetates, metal stearates, metal laureates, metal oleates, metal palmitates and the like.

The final blend composition preferably is prepared by mixing the above materials into each other thoroughly, either by using a dispersive mixing mechanism, a distributive mixing mechanism, or a combination of these. These mixing methods are well known in the manufacture of polymer blends. As a result of this mixing, the acidic functional group of Component B is dispersed evenly throughout the mixture in either their neutralized or non-neutralized state. Most preferably, Components A and B are melt-mixed together without Component C, with or without the premixing discussed above, to produce a melt-mixture of the two components. Then, Component C separately is mixed into the blend of Components A and B. This mixture is melt-mixed to produce the reaction product. This two-step mixing can be performed in a single process, such as, for example, an extrusion process using a proper barrel length or screw configuration, along with a multiple feeding system.

Such blends are described in more detail in commonly-assigned U.S. Pat. No. 6,930,150, to Kim et al, the content of which is incorporated by reference herein in its entirety.

The golf balls of the present invention, and especially the cores of the golf balls of the present invention may include the traditional rubber components used in golf ball applications including, both natural and synthetic rubbers, such as cis-1, 4-polybutadiene, trans-1,4-polybutadiene, 1,2-polybutadiene, cis-polyisoprene, trans-polyisoprene, polychloroprene, polybutylene, styrene-butadiene rubber, styrene-butadiene-styrene block copolymer and partially and fully hydrogenated equivalents, styrene-isoprene-styrene block copolymer and partially and fully hydrogenated equivalents, nitrile rubber, silicone rubber, and polyurethane, as well as mixtures of these. Polybutadiene rubbers, especially 1,4-polybutadiene rubbers containing at least 40 mol %, and more preferably 80 to 100 mol % of cis-1,4 bonds, are preferred because of their high rebound resilience, moldability, and high strength after vulcanization. The polybutadiene component may be synthesized by using rare earth-based catalysts, nickel-based catalysts, or cobalt-based catalysts, conventionally used in this field. Polybutadiene obtained by using lanthanum rare earth-based catalysts usually employ a combination of a lanthanum rare earth (atomic number of 57 to 71)-compound, but particularly preferred is a neodymium compound.

The cores of the golf balls of the present invention may also include polyalkenamers. Examples of suitable polyalkenamer rubbers are polypentenamer rubber, polyheptenamer rubber, polyoctenamer rubber, polydecenamer rubber and polydodecenamer rubber. For further details concerning polyalkenamer rubber, see *Rubber Chem. & Tech.*, Vol. 47, page 511-596, 1974, which is incorporated herein by reference. Polyoctenamer rubbers are commercially available from Huls AG of Marl, Germany, and through its distributor in the U.S., Creanova Inc. of Somerset, N.J., and sold under the trademark VESTENAMER®. Two grades of the VESTENAMER® trans-polyoctenamer are commercially available: VESTENAMER 8012 designates a material having a trans-content of approximately 80% (and a cis-content of 20%) with a melting point of approximately 54° C.; and VESTENAMER 6213 designates a material having a trans-content of approximately 60% (cis-content of 40%) with a melting point of approximately 30° C. Both of these polymers have a double bond at every eighth carbon atom in the ring. This is disclosed in copending U.S. application Ser. No. 11/335,070, filed on Jan. 18, 2006, in the name of Hyun Kim et al. The entire contents of which are hereby incorporated by reference.

A more preferred composition for use in the golf balls of the present invention and preferably for use in the golf ball core or intermediate layers is a blend of polyalkenamer and polyamide as also disclosed in copending U.S. application Ser. No. 11/335,070, filed on Jan. 18, 2006, in the name of Hyun Kim et al., the entire contents of which are hereby incorporated by reference.

When synthetic rubbers such as the aforementioned polybutadienes or polyalkenamers and their blends are used in the golf balls of the present invention they may contain further materials typically often used in rubber formulations including crosslinking agents, co-crosslinking agents, peptizers and accelerators.

Suitable cross-linking agents for use in the golf balls of the present invention include peroxides, sulfur compounds, or other known chemical cross-linking agents, as well as mixtures of these. Non-limiting examples of suitable cross-linking agents include primary, secondary, or tertiary aliphatic or aromatic organic peroxides such as Trigonox 145-45B, marketed by Akrochem Corp. of Akron, Ohio; 1,1-bis(t-butylperoxy)-3,3,5 tri-methylcyclohexane, such as Varox 231-XL, marketed by R.T. Vanderbilt Co., Inc. of Norwalk, Conn.; and di-(2,4-dichlorobenzoyl)peroxide.

Besides the use of chemical cross-linking agents, exposure of the composition to radiation also can serve as a cross-linking agent. Radiation can be applied to the unsaturated polymer mixture by any known method, including using microwave or gamma radiation, or an electron beam device. Additives may also be used to improve radiation curing of the diene polymer.

The rubber and cross-linking agent may be blended with a co-cross-linking agent, which may be a metal salt of an unsaturated carboxylic acid. Examples of these include zinc and magnesium salts of unsaturated fatty acids having 3 to 8 carbon atoms, such as acrylic acid, methacrylic acid, maleic acid, and fumaric acid, palmitic acid with the zinc salts of acrylic and methacrylic acid being most preferred. The core compositions used in the present invention may also incorporate one or more of the so-called "peptizers".

The peptizer preferably comprises an organic sulfur compound and/or its metal or non-metal salt. Examples of such organic sulfur compounds include thiophenols, such as pentachlorothiophenol, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; di(pentachlorophenyl)disulfide; dibenzamido diphenyldisulfide (DBDD), and alkylated phenol sulfides, such as VULTAC marketed by Atofina Chemicals, Inc. of Philadelphia, Pa. Preferred organic sulfur compounds include pentachlorothiophenol, and dibenzamido diphenyldisulfide.

Examples of the metal salt of an organic sulfur compound include sodium, potassium, lithium, magnesium calcium, barium, cesium and zinc salts of the above-mentioned thiophenols and thiocarboxylic acids, with the zinc salt of pentachlorothiophenol being most preferred.

Examples of the non-metal salt of an organic sulfur compound include ammonium salts of the above-mentioned thiophenols and thiocarboxylic acids wherein the ammonium cation has the general formula $[NR^1R^2R^3R^4]^+$ where $R^1$, $R^2$, $R^3$ and $R^4$ are selected from the group consisting of hydrogen, a $C_1$-$C_{20}$ aliphatic, cycloaliphatic or aromatic moiety, and any and all combinations thereof, with the most preferred being the $NH_4^+$-salt of pentachlorothiophenol.

Additional peptizers include aromatic or conjugated peptizers comprising one or more heteroatoms, such as nitrogen, oxygen and/or sulfur. More typically, such peptizers are heteroaryl or heterocyclic compounds having at least one heteroatom, and potentially plural heteroatoms, where the plural heteroatoms may be the same or different. Such peptizers include peptizers such as an indole peptizer, a quinoline peptizer, an isoquinoline peptizer, a pyridine peptizer, purine peptizer, a pyrimidine peptizer, a diazine peptizer, a pyrazine peptizer, a triazine peptizer, a carbazole peptizer, or combinations of such peptizers.

Such peptizers are more fully disclosed in copending U.S. Application No. 60/752,475 filed on Dec. 20, 2005 in the name of Hyun Kim et al, the entire contents of which are herein incorporated by reference.

The polymeric compositions used to prepare the golf balls of the present invention also can incorporate one or more fillers. Such fillers are typically in a finely divided form, for example, in a size generally less than about 20 mesh, preferably less than about 100 mesh U.S. standard size, except for fibers and flock, which are generally elongated. Filler particle size will depend upon desired effect, cost, ease of addition, and dusting considerations. The appropriate amounts of filler required will vary depending on the application but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten, steel, copper, cobalt or iron, metal alloys, tungsten carbide, metal oxides, metal stearates, and other particulate carbonaceous materials, and any and all combinations thereof. Preferred examples of fillers include metal oxides, such as zinc oxide and magnesium oxide. In another preferred embodiment the filler comprises a continuous or non-continuous fiber. In another preferred embodiment the filler comprises one or more so called nanofillers, as described in U.S. Pat. No. 6,794,447 and copending U.S. patent application Ser. No. 10/670,090 filed on Sep. 24, 2003 and copending U.S. patent application Ser. No. 10/926,509 filed on Aug. 25, 2004, the entire contents of each of which are incorporated herein by reference.

Examples of commercial nanofillers are various Cloisite grades including 10A, 15A, 20A, 25A, 30B, and NA+ of Southern Clay Products (Gonzales, Tex.) and the Nanomer grades including 1.24TL and C.30EVA of Nanocor, Inc. (Arlington Heights, Ill.).

If desired, the various polymer compositions used to prepare the golf balls of the present invention can additionally contain other conventional additives such as plasticizers, pigments, antioxidants, U.V. absorbers, optical brighteners, or any other additives generally employed in plastics formulation or the preparation of golf balls.

Another particularly well-suited additive for use in the compositions of the present invention includes compounds having the general formula:

$$(R_2N)_m—R'—(X(O)_nOR_y)_m,$$

where R is hydrogen, or a $C_1$-$C_{20}$ aliphatic, cycloaliphatic or aromatic systems; R' is a bridging group comprising one or more $C_1$-$C_{20}$ straight chain or branched aliphatic or alicyclic groups, or substituted straight chain or branched aliphatic or alicyclic groups, or aromatic group, or an oligomer of up to 12 repeating units including, but not limited to, polypeptides derived from an amino acid sequence of up to 12 amino acids; and X is C or S or P with the proviso that when X=C, n=1 and y=1 and when X=S, n=2 and y=1, and when X=P, n=2 and y=2. Also, m=1-3. These materials are more fully described in copending U.S. patent application Ser. No. 11/182,170, filed on Jul. 14, 2005, the entire contents of which are incorporated herein by reference.

Most preferably the material is selected from the group consisting of 4,4'-methylene-bis-(cyclohexylamine)carbamate (commercially available from R.T. Vanderbilt Co., Norwalk Conn. under the tradename Diak® 4), 11-aminoundecanoic acid, 12-aminododecanoic acid, epsilon-caprolactam; omega-caprolactam, and any and all combinations thereof.

In an especially preferred embodiment a nanofiller additive component in the golf ball of the present invention is surface modified with a compatibilizing agent comprising the earlier described compounds having the general formula:

$$(R_2N)_m—R'—(X(O)_nOR_y)_m,$$

A most preferred embodiment would be a filler comprising a nanofiller clay material surface modified with an amino acid including 12-aminododecanoic acid. Such fillers are available from Nanonocor Co. under the tradename Nanomer 1.24TL.

Various compositions used as a component of the golf balls of the present invention may also comprise a monomeric amide modifier or modifiers, such as a monomeric aliphatic and/or aromatic amide polymer modifier or modifiers. These materials are more fully described in copending U.S. patent application Ser. No. 11/592,109, filed on Nov. 1, 2006, the entire contents of which are incorporated herein by reference.

Golf balls within the scope of the present invention also can include, in suitable amounts, one or more additional ingredients generally employed in golf ball compositions. Agents provided to achieve specific functions, such as additives and stabilizers, can be present. Exemplary suitable ingredients include colorants, antioxidants, colorants, dispersants, mold releasing agents, processing aids, fillers, and any and all combinations thereof. Although not required, UV stabilizers, or photo stabilizers such as substituted hydroxphenyl benzotriazoles may be utilized in the present invention to enhance the UV stability of the final compositions. An example of a commercially available UV stabilizer is the stabilizer sold by Ciba Geigy Corporation under the tradename TINUVIN.

Typically, the golf ball compositions are made by mixing together the various components and other additives with or without melting them. Dry blending equipment, such as a tumble mixer, V-blender, ribbon blender, or two-roll mill, can be used to mix the compositions. The golf ball compositions can also be mixed using a mill, internal mixer such as a Banbury or Farrel continuous mixer, extruder or combinations of these, with or without application of thermal energy to produce melting. The various core components can be mixed together with the cross-linking agents, or each additive can be added in an appropriate sequence to the milled unsaturated polymer. The resulting mixture can be subjected to, for example, a compression or injection molding process, to obtain solid spheres for the core. The polymer mixture is subjected to a molding cycle in which heat and pressure are applied while the mixture is confined within a mold. The cavity shape depends on the portion of the golf ball being formed. The compression and heat liberates free radicals by decomposing one or more peroxides, which initiate cross-linking. The temperature and duration of the molding cycle are selected based upon the type of peroxide and peptizer selected. The molding cycle may have a single step of molding the mixture at a single temperature for fixed time duration.

The various intermediate layer and/or cover formulations may be produced using a twin-screw extruder or can be blended manually or mechanically prior to the addition to the injection molder feed hopper. Finished golf balls may be prepared by initially positioning the solid preformed core in an injection-molding cavity followed by uniform injection of the intermediate and/or cover layer composition sequentially over the core. The cover formulations can be injection molded around the cores to produce golf balls of the required diameter.

Alternatively, the cover layers may also be formed around the core by first forming half shells by injection molding followed by compression molding the half shells about the core to form the final ball.

Covers may also be formed around the cores using compression molding. Cover materials for compression molding may also be extruded or blended resins or castable resins.

Figure 5:
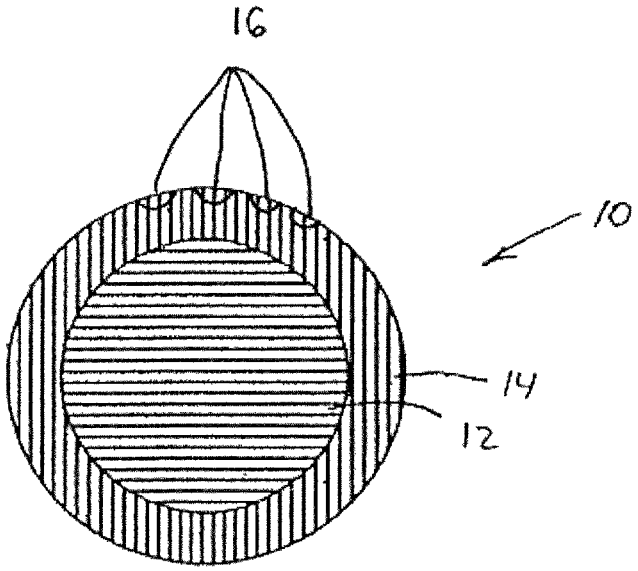
FIG. 5 illustrates a two-piece golf ball 10 comprising a solid center or core 12, and an outer cover layer 14. Golf balls also typically include plural dimples 16 formed in the outer cover (dimples 16 are not to scale, and FIG. 5 does not show the presently disclosed dimple pattern).

In the case of covers made from a thermoset polyurethane or polyurea composition a most preferred method is that of casting Referring to the drawing in FIG. 5, there is illustrated a two piece golf ball 10, which comprises a solid center or core 12, which may be foamed as a solid body of the herein described compositions, and in the shape of a sphere, which core is further enclosed by an outer cover layer, 14.

The core of the two-piece golf balls of the present invention has a diameter of from about 0.5 to about 1.62, preferably from about 0.7 to about 1.60, more preferably from about 1 to about 1.58 inches.

The core of the two-piece golf balls of the present invention has a PGA compression of from about 10 to about 100, preferably from about 35 to about 90, more preferably from about 40 to about 80.

The cover of the two piece golf balls of the present invention has a thickness of from about 0.01 to about 0.20, preferably from about 0.02 to about 0.15, more preferably from about 0.03 to about 0.10 and most preferably from about 0.03 to about 0.07 inches.

In addition, the cover of the two piece golf balls of the present invention has a hardness of from about 25 to about 80, more preferably from about 30 to about 70, even more preferably from about 40 to about 60 Shore D.

The two piece golf ball of the present invention has a PGA ball compression greater than about 30, preferably greater than 40, more preferably greater than about 50, most preferably greater than about 60.

Figure 6:
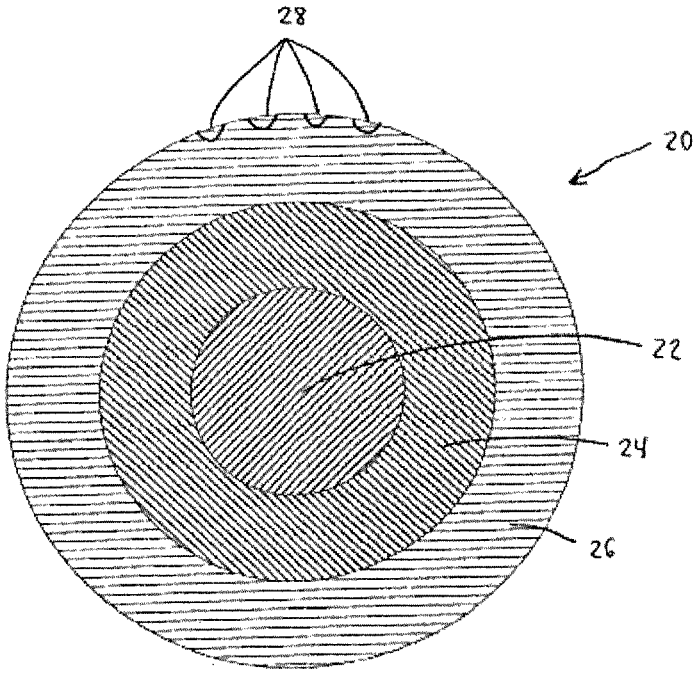
FIG. 6 illustrates a 3-piece golf ball 20 comprising a core 22, an intermediate layer 24 and an outer cover layer 26. Golf ball 20 also typically includes plural dimples 28 formed in the outer cover layer 26 (dimples 28 are not to scale, and FIG. 6 does not shown the presently disclosed dimple pattern).

Referring to the drawing in FIG. 6, there is illustrated a 3-piece golf ball 20 comprising a core 22, an intermediate layer 24 and an outer cover layer 26. Golf ball 20 also typically includes plural dimples 28 formed in the outer cover layer 26 and arranged in various desired patterns.

The core of the three piece golf balls of the present invention has a diameter of from about 0.5 to about 1.62, preferably from about 0.7 to about 1.60, more preferably from about 1 to about 1.58 inches.

The core of the three piece golf balls of the present invention has a PGA compression of from about 10 to about 100, preferably from about 35 to about 90, more preferably from about 40 to about 80.

The cover of the three piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The cover of the three piece golf balls of the present invention also has a hardness of from about 25 to about 80, more preferably from about 30 to about 70, even more preferably from about 40 to about 60 Shore D.

The three piece golf balls of the present invention has a PGA ball compression greater than about 30, preferably greater than 40, more preferably greater than about 50, most preferably greater than about 60.

Figure 2:
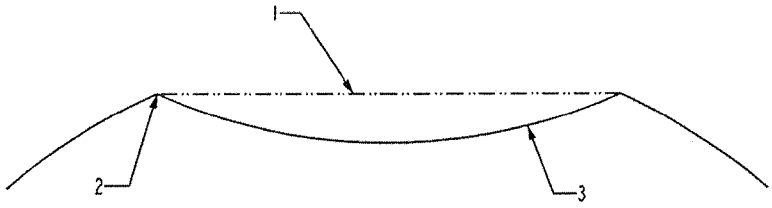
FIG. 2, shows a cross section of a dimple where the dimple volume is defined as the volume occupied by the region between a plane 1 that intersects the dimple edge 2 and the surface of the dimple 3 for dimples of circular edge.
Figure 3:
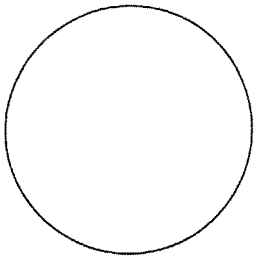
FIG. 3 illustrates the shape of a dimple 8 with a circular edge.
Figure 4:
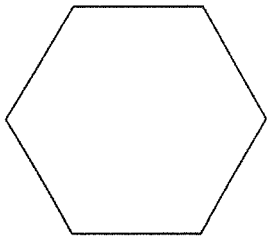
FIG. 4 illustrates an example of the shape of a dimple 8 with a non-circular edge.

Although FIGS. 1 and 2 illustrate only two- and three-piece golf ball constructions, golf balls of the present invention may comprise from 0 to at least 5 intermediate layer(s), preferably from 0 to 3 intermediate layer(s), more preferably from 1 to 3 intermediate layer(s), and most preferably 1 to 2 intermediate layer(s).

The core of the golf balls of the present invention having two or more intermediate layers has a diameter of from about 0.5 to about 1.62, preferably from about 0.7 to about 1.60, more preferably from about 1 to about 1.58, yet more preferably from about 1.20 to about 1.54, and most preferably from about 1.40 to about 1.50 in.

The core the golf balls of the present invention having two or more intermediate layers has a PGA compression of from about 10 to about 100, preferably from about 35 to about 90, more preferably from about 40 to about 80.

The core the golf balls of the present invention having two or more intermediate layers may also comprise a center and one or more core layers disposed around the center. These core layers may be made from the same rubber as used in the center portion, or may be a different thermoplastic elastomer. The various core layers (including the center) may each exhibit a different hardness. The difference between the center hardness and that of the next adjacent layer, as well as the difference in hardness between the various core layers is greater than 2, preferably greater than 5, most preferably greater than 10 units of Shore D.

In one preferred embodiment, the hardness of the center and each sequential layer increases progressively outwards from the center to outer core layer.

In another preferred embodiment, the hardness of the center and each sequential layer decreases progressively inwards from the outer core layer to the center.

The intermediate layers of the golf balls of the present invention having two or more intermediate layers has a thickness of about 0.01 to about 0.50, preferably from about 0.02 to about 0.30 or more preferably from about 0.03 to about 0.20 or most preferably from about 0.03 to about 0.10 in.

The intermediate layers of the golf balls of the present invention having two or more intermediate layers also has a hardness greater than about 25, preferably greater than about 30, more preferably greater than about 40, and most preferably greater than about 50, Shore D units as measured on the ball.

The intermediate layers of the golf balls of the present invention having two or more intermediate layers also has a flexural modulus from about 5 to about 500, preferably from about 15 to about 400, more preferably from about 20 to about 300, still more preferably from about 25 to about 200, and most preferably from about 30 to about 150 kpsi.

The cover layer of the golf balls of the present invention having two or more intermediate layers has a thickness of about 0.01 to about 0.10, preferably from about 0.02 to about 0.08, more preferably from about 0.03 to about 0.06 in.

The cover layer of the golf balls of the present invention having two or more intermediate layers also has a hardness from about 40 to about 70, preferably from about 45 to about 70 or about 50 to about 70, more preferably from 47 to about 68 or about 45 to about 70, and most preferably from about 50 to about 65 Shore D as measured on the ball.

The COR of the two, three- or multi-piece golf balls of the present invention is greater than about 0.760, preferably greater than about 0.780, more preferably greater than 0.790, most preferably greater than 0.795, and especially greater than 0.800 at 125 ft/sec inbound velocity.

The COR of the two, three- or multi-piece golf balls of the present invention is also greater than about 0.760, preferably greater than about 0.780, more preferably greater than 0.790, most preferably greater than 0.795, and especially greater than 0.800 at 143 ft/sec inbound velocity.

EXAMPLES

The following examples are provided to illustrate certain features of working embodiments of the disclosed invention. A person of ordinary skill in the art will appreciate that the invention is not limited to those features exemplified by these working embodiments.

A golf ball having the dimple pattern of the present invention, Example 1, and Comparative Examples 1 and 2 have been examined. Example 1 was a three piece ball having a cis-polybutadiene core with a diameter of 1.48 inches and surrounded by an ionomers mantle having a thickness of 0.068 inches and a Shore D measured on the ball of 65 and a cast polyurethane cover having a thickness of 0.03 inches and a Shore D measure don the ball of 58. Comparative Example 1 was a MAXFLI Noodle Long and Soft golf ball. Comparative Example 2 was a MAXFLI Revolution EXT golf ball. The results are shown in Table 1 below. The golf balls in the examples have a plurality of dimples of different volume. The dimples are disposed on the surface with the total dimple volume as denoted in Table 1. As is clearly shown, Example 1 has both Vs/Ve and Vp/Vs less than 0.97. The Comparative Examples 1 and 2 have at least one of the ratios over 0.97. The value of the drag coefficient in the table, CDp, refers to the parasite drag of the dimple pattern and was measured experimentally at 160 mph and 2000 rpm. The value of CL/CD refers to the ratio of lift coefficient to total drag coefficient.

For balls with low to moderate spin rates it is important to decrease parasite drag and increase the lift-to-drag ratio when assessing carry distance. In the table, Example 1 has superior parasite drag and CL/CD relative to the comparative examples.

TABLE 1

Examples Of The Present Invention As Well As Comparative Examples.

| Property | Units | Example 1 | Comparative Example 1 | Comparative Example 2 |
|---|---|---|---|---|
| Total No. of Dimples | — | 360 | 408 | 442 |
| Te | $mm^3$ | 151.69 | 183.23 | 165.79 |
| Ts | $mm^3$ | 198.72 | 187.73 | 168.56 |
| Top | $mm^3$ | 33.67 | 31.51 | 42.73 |
| TDV | $mm^3$ | 384.08 | 402.46 | 377.08 |
| Ne | — | 132 | 186 | 190 |
| Ns | — | 192 | 186 | 200 |
| Np | | 36 | 36 | 52 |
| Ve | $mm^3$ | 1.1492 | 0.9851 | 0.8726 |
| Vs | $mm^3$ | 1.035 | 1.0093 | 0.8428 |
| Vp | $mm^3$ | 0.9352 | 0.8752 | 0.8216 |
| Vs/Ve | — | 0.9006 | 1.0246 | 0.9659 |
| Vp/Vs | — | 0.9036 | 0.8671 | 0.9749 |
| CDp | | 0.191 | 0.196 | 0.193 |
| CL/CD | — | 0.632 | 0.576 | 0.591 |

What is claimed is:

1. A golf ball having an equator at latitude 0° and a pole at latitude 90°; and an equator region defined by latitudes 0 to 25°, a shoulder region defined by latitudes from more than 25° to less than 65°, and a pole region defined by latitudes 65° to 90°; and having numerous dimples on the surface thereof, and where Ve is the average dimple volume of the equator region, Vs is the average dimple volume of the shoulder region, and Vp is the average dimple volume of the pole region; and the ratio Vs/Ve is less than 0.97 and the ratio Vp/Vs is less than 0.97, and further comprising;

1) a core comprising a center, 2) an outer cover layer; and 3) four or five intermediate layers.

2. The golf ball of claim 1, wherein the core comprises polybutadiene, the intermediate layers each individually comprise a polyalkenamer or an ionomer, and the outer cover layer comprises a thermoset polyurethane or polyurea.

3. The golf ball of claim 2, wherein the core further comprises a peptizer.

4. The golf ball of claim 3, wherein the peptizer comprises a pyridine peptizer.

5. The golf ball of claim 2, wherein the ionomer comprises a modified ionomer.

* * * * *